US011530471B2

(12) United States Patent
Ando et al.

(10) Patent No.: US 11,530,471 B2
(45) Date of Patent: Dec. 20, 2022

(54) RAIL AND METHOD FOR MANUFACTURING SAME

(71) Applicant: JFE STEEL CORPORATION, Tokyo (JP)

(72) Inventors: Keisuke Ando, Tokyo (JP); Tatsumi Kimura, Tokyo (JP); Satoshi Igi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 183 days.

(21) Appl. No.: 17/040,539

(22) PCT Filed: Mar. 28, 2019

(86) PCT No.: PCT/JP2019/013866
§ 371 (c)(1),
(2) Date: Sep. 23, 2020

(87) PCT Pub. No.: WO2019/189688
PCT Pub. Date: Oct. 3, 2019

(65) Prior Publication Data

US 2021/0025043 A1 Jan. 28, 2021

(30) Foreign Application Priority Data

Mar. 30, 2018 (JP) ..... JP2018-068797

(51) Int. Cl.
*C22C 38/34* (2006.01)
*C21D 8/02* (2006.01)
*C22C 38/60* (2006.01)

(52) U.S. Cl.
CPC ..... *C22C 38/34* (2013.01); *C21D 8/0226* (2013.01); *C22C 38/60* (2013.01)

(58) Field of Classification Search
CPC ..... C21D 2211/002; C21D 2211/009; C21D 6/002; C21D 6/005; C21D 6/008;
(Continued)

(56) References Cited

U.S. PATENT DOCUMENTS 4,375,995 A 3/1983 Sugino et al.
5,658,400 A 8/1997 Uchino et al.
(Continued)

FOREIGN PATENT DOCUMENTS

CN 101646795 A 2/2010
CN 106103772 A 11/2016
(Continued)

OTHER PUBLICATIONS

Aug. 4, 2020, Notification of Reasons for Refusal issued by the Japan Patent Office in the corresponding Japanese Patent Application No. 2019-538468 with English language Concise Statement of Relevance.
(Continued)

*Primary Examiner* — Jenny R Wu
(74) *Attorney, Agent, or Firm* — Kenja IP Law PC

(57) ABSTRACT

The rail having a chemical composition containing C: 0.70-0.85 mass %, Si: 0.50-1.60 mass %, Mn: 0.20-1.00 mass %, P: 0.035 mass % or less, S: 0.012 mass % or less, Cr: 0.40-1.30 mass %, the chemical composition satisfying the formula (1)

$$0.30 \leq [\%\ Si]/10+[\%\ Mn]/6+[\%\ Cr]/3 \leq 0.55 \quad (1)$$

where [% M] is the content in mass % of the element M, the balance being Fe and inevitable impurities, where Vickers hardness of a region between positions where a depth from a surface of a rail head of 0.5 and 25 mm is ≥370 HV and <520 HV, a total area ratio of a pearlite microstructure
(Continued)

and a bainite microstructure in the region is ≥98%, and an area ratio of the bainite microstructure in the region is >5% and <20%.

8 Claims, 4 Drawing Sheets

(58) Field of Classification Search
CPC ..... C21D 8/0226; C21D 9/04; C22C 38/02; C22C 38/04; C22C 38/18; C22C 38/34; C22C 38/60
See application file for complete search history.

(56) References Cited

U.S. PATENT DOCUMENTS

| | | | |
|---|---|---|---|
| 5,762,723 | A | 6/1998 | Ueda et al. |
| 7,955,445 | B2 | 6/2011 | Honjo et al. |
| 2011/0303756 | A1 | 12/2011 | Ueda et al. |
| 2015/0136864 | A1 | 5/2015 | Ueda et al. |
| 2016/0010188 | A1 | 1/2016 | Han et al. |
| 2016/0083820 | A1 | 3/2016 | Kimura et al. |
| 2017/0051373 | A1 | 2/2017 | Ueda et al. |
| 2017/0101692 | A1* | 4/2017 | Kimura ..... C21D 6/008 |
| 2017/0369975 | A1 | 12/2017 | Ueda et al. |
| 2019/0249280 | A1 | 8/2019 | Honjo et al. |

FOREIGN PATENT DOCUMENTS

| | | | |
|---|---|---|---|
| EP | 3124636 | A1 | 2/2017 |
| JP | H0892645 | A | 4/1996 |
| JP | H08109439 | A | 4/1996 |
| JP | H08144016 | A | 6/1996 |
| JP | H08246100 | A | 9/1996 |
| JP | H08246101 | A | 9/1996 |
| JP | H10195601 | A | 7/1998 |
| JP | 2002069585 | A | 3/2002 |
| JP | 2003293086 | A | 10/2003 |
| JP | 2010077481 | A | 4/2010 |
| JP | 2010077481 | A * | 4/2010 |
| JP | 2016156071 | A | 9/2016 |
| WO | 2014157252 | A1 | 10/2014 |
| WO | 2015146150 | A1 | 10/2015 |
| WO | 2017104719 | A1 | 6/2017 |

OTHER PUBLICATIONS

Jun. 25, 2019, International Search Report issued in the International Patent Application No. PCT/JP2019/013866.

May 19, 2021, Office Action issued by the IP Australia in the corresponding Australian Patent Application No. 2019242158.

Oct. 13, 2021, Office Action issued by the Canadian Intellectual Property Office in the corresponding Canadian Patent Application No. 3,094,157.

Jun. 30, 2021, Office Action issued by the China National Intellectual Property Administration in the corresponding Chinese Patent Application No. 201980020267.8 with English language search report.

Nov. 20, 2020, the Extended European Search Report issued by the European Patent Office in the corresponding European Patent Application No. 19778342.6.

* cited by examiner

RAIL AND METHOD FOR MANUFACTURING SAME

TECHNICAL FIELD

This disclosure relates to a rail, particularly a rail having both improved wear resistance and improved fatigue damage resistance, and to a method of manufacturing a rail with which the rail can be advantageously manufactured.

BACKGROUND

In heavy haul railways mainly built to transport ore, the load applied to the axle of a freight car is much higher than that in passenger cars, and rails are used in increasingly harsh environments. Conventionally, steels having a pearlite microstructure have been mainly used for the rails used under such circumstances from the viewpoint of the importance of wear resistance. In recent years, however, in order to improve the efficiency of transportation by railways, the loading weight on freight cars is becoming larger and larger, and consequently, there is a need for further improvement of wear resistance and fatigue damage resistance. Note that heavy haul railways are railways where trains and freight cars haul large loads (loading weight is about 150 tons or more, for example).

In order to further improve the wear resistance of the rail, for example, it has been proposed to increase the C content to increase the cementite fraction, thereby improving the wear resistance, such as increasing the C content to more than 0.85 mass % and 1.20 mass % or less, like JP H08-109439 A (PTL 1) and JP H08-144016 A (PTL 2), or increasing the C content to more than 0.85 mass % and 1.20 mass % or less and subjecting a rail head to heat treatment, like JP H08-246100 A (PTL 3) and JP H08-246101 A (PTL 4).

On the other hand, because the rails in a curved section of heavy haul railways are applied with rolling contact loading caused by wheels and sliding force caused by centrifugal force, wear of the rails is more severe than other sections, and fatigue damage occurs due to sliding. If it is simply setting the C content to more than 0.85 mass % and 1.20 mass % or less as proposed above, a pro-eutectoid cementite microstructure is formed depending on heat treatment conditions, and the number of cementite layers of a brittle pearlite lamellar microstructure is increased. As a result, the fatigue damage resistance cannot be improved.

Therefore, J P 2002-69585 A (PTL 5) proposes a technique of adding Al and Si to suppress the formation of pro-eutectoid cementite, thereby improving the fatigue damage resistance. However, it is difficult to satisfy both the wear resistance and the fatigue damage resistance in a steel rail having a pearlite microstructure, because the addition of Al leads to the formation of oxides that are the initiation point of fatigue damage.

JP H10-195601 A (PTL 6) improves the service life of the rail by setting the Vickers hardness of a region of at least 20 mm deep from the surface of a head corner and a head top of a rail to 370 HV or more. JP 2003-293086 A (PTL 7) controls pearlite block size to obtain a hardness in a region of at least 20 mm deep from the surface of a head corner and a head top of a rail within a range of 300 HV or more and 500 HV or less, thereby improving the service life of the rail.

CITATION LIST

Patent Literature

PTL 1: JP H08-109439 A
PTL 2: JP H08-144016 A

PTL 3: JP H08-246100 A
PTL 4: JP H08-246101 A
PTL 5: JP 2002-69585 A
PTL 6: JP H10-195601 A
PTL 7: JP 2003-293086 A

SUMMARY

Technical Problem

However, since the rails are used in increasingly harsh environments, it has been difficult to improve the service life of the rail, that is, to achieve both excellent wear resistance and excellent fatigue damage resistance, only by controlling the pearlite microstructure. It could thus be helpful to provide a rail with high internal hardness having both improved wear resistance and improved fatigue damage resistance as well as a method of manufacturing the same.

Solution to Problem

In order to solve the problem, we prepared rails having different Si, Mn, and Cr contents, and intensely investigated their microstructure, wear resistance, and fatigue damage resistance. As a result, we discovered that, by optimizing the amounts of Si, Mn and Cr added and the volume fraction between a pearlite microstructure excellent in wear resistance and a bainite microstructure excellent in fatigue damage resistance and controlling the hardness of a region from a position where a depth from a rail head is 0.5 mm to a position where the depth is 25 mm to a predetermined range, it is possible to stably maintain the effect of improving wear resistance and fatigue damage resistance.

The present disclosure is based on the above discoveries and primary features thereof are as follows.

1. A rail comprising a chemical composition containing (consisting of)

C: 0.70 mass % or more and 0.85 mass % or less,
Si: 0.50 mass % or more and 1.60 mass % or less,
Mn: 0.20 mass % or more and 1.00 mass % or less,
P: 0.035 mass % or less,
S: 0.012 mass % or less, and
Cr: 0.40 mass % or more and 1.30 mass % or less, where the chemical composition satisfies the following formula (1)

$$0.30 \leq [\%\ Si]/10+[\%\ Mn]/6+[\%\ Cr]/3 \leq 0.55 \quad (1)$$

where [% M] is the content in mass % of the element M in the chemical composition, the balance being Fe and inevitable impurities, wherein Vickers hardness of a region between a position where a depth from a surface of a rail head is 0.5 mm and a position where the depth is 25 mm is 370 HV or more and less than 520 HV, a total area ratio of a pearlite microstructure and a bainite microstructure in the region is 98% or more, and an area ratio of the bainite microstructure in the region is more than 5% and less than 20%.

2. The rail according to the above 1, wherein the chemical composition further contains at least one selected from the group consisting of V: 0.30 mass % or less,
Cu: 1.0 mass % or less,
Ni: 1.0 mass % or less,
Nb: 0.05 mass % or less, and
Mo: 0.5 mass % or less.

3. The rail according to the above 1. or 2, wherein the chemical composition further contains at least one selected from the group consisting of Al: 0.07 mass % or less, W: 1.0 mass % or less, B: 0.005 mass % or less, Ti: 0.05 mass % or less, and Sb: 0.05 mass % or less.

4. A method of manufacturing a rail, comprising subjecting a steel material having the chemical composition according to any one of the above 1. to 3. to hot rolling where a finish temperature is 850° C. or higher and 950° C. or lower, then to cooling where a cooling start temperature is equal to or higher than a pearlite transformation start temperature, a cooling stop temperature is 350° C. or higher and 600° C. or lower, and a cooling rate is 2° C./s or higher and 10° C./s or lower.

Advantageous Effect

According to the present disclosure, it is possible to stably manufacture a rail with high internal hardness having a far superior wear resistance-fatigue damage resistance balance as compared with conventional rails. It contributes to a long service life of rails for heavy haul railways and prevention of railway accidents, which is beneficial in industrial terms.

DETAILED DESCRIPTION

Figure 1:
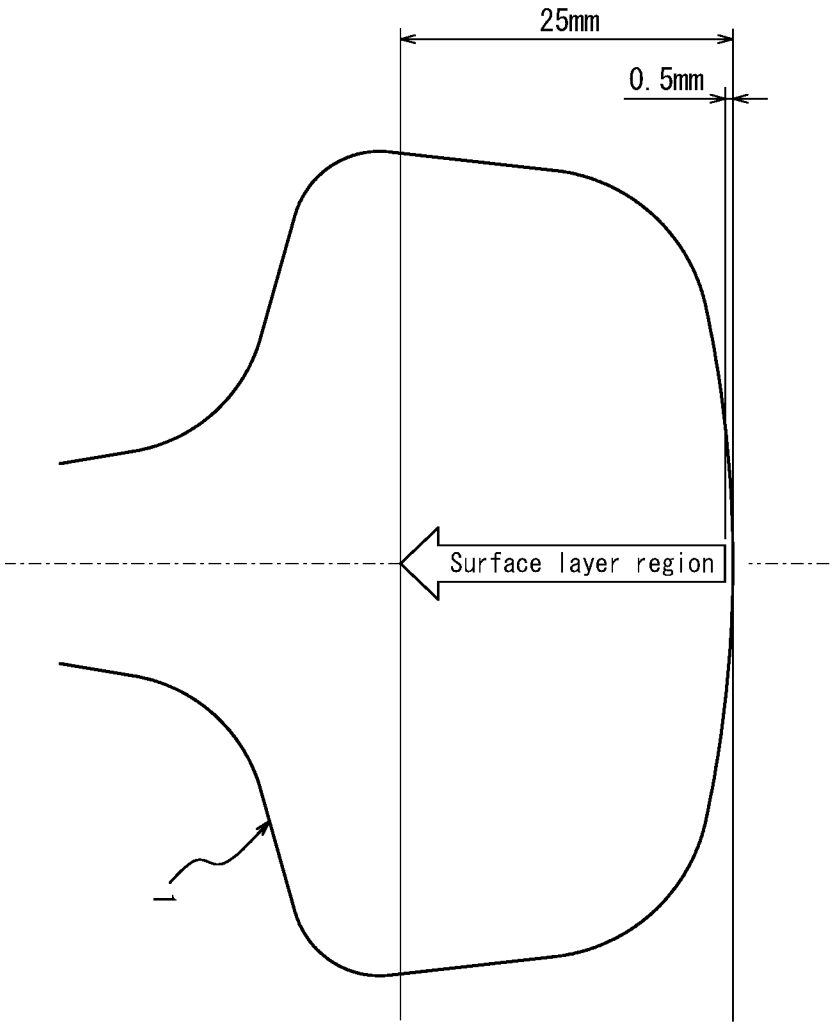
FIG. 1 is a cross-sectional view of a rail head indicating the measurement position of the internal hardness of the rail head.

The following describes the present disclosure in detail. The reasons why the present disclosure limits the chemical composition of the rail steel to the above ranges are described first.

C: 0.70 mass % or more and 0.85 mass % or less

C is an essential element for forming cementite in a pearlite microstructure and ensuring wear resistance, and the wear resistance improves as the content of C increases. However, when the C content is less than 0.70 mass %, it is difficult to obtain excellent wear resistance as compared with a conventional heat-treated pearlite steel rail. In addition, when the C content exceeds 0.85 mass %, pro-eutectoid cementite is formed at austenite grain boundaries at the time of transformation after the hot rolling for shaping the steel into a rail shape, and the fatigue damage resistance is remarkably decreased. Therefore, the C content is 0.70 mass % or more and 0.85 mass % or less. The C content is preferably 0.75 mass % or more and 0.85 mass % or less.

Si: 0.50 mass % or more and 1.60 mass % or less

Si is a deoxidizer and an element that strengthens a pearlite microstructure. Therefore, it should be contained at a content of 0.50 mass % or more. However, when the content exceeds 1.60 mass %, the weldability is deteriorated due to the high bonding strength between Si and oxygen. Further, Si highly improves the hardenability of the steel. Therefore, if the hardness inside the rail is increased, a large amount of bainite microstructure is formed in the surface layer of the rail, which decreases the wear resistance. Therefore, the Si content is 0.50 mass % or more and 1.60 mass % or less. The Si content is preferably 0.50 mass % or more and 1.20 mass % or less.

Mn: 0.20 mass % or more and 1.00 mass % or less

Mn lowers the pearlite transformation temperature and refines the lamellar spacing, thereby increasing the strength and the ductility of the rail with high internal hardness. However, when Mn is excessively contained in the steel, the equilibrium transformation temperature of pearlite is lowered, and as a result, the degree of supercooling is reduced and the lamellar spacing is coarsened. When the Mn content is less than 0.20 mass %, the effect of increasing the strength and the ductility cannot be sufficiently obtained. On the other hand, when the Mn content exceeds 1.00 mass %, a martensite microstructure is likely to be formed, and the material is likely to be deteriorated due to hardening and brittleness occurred during the heat treatment and welding of the rail. In addition, Mn highly improves the hardenability of the steel. Therefore, if the hardness inside the rail is increased, a large amount of bainite microstructure is formed in the surface layer of the rail, which decreases the wear resistance. Further, the equilibrium transformation temperature is lowered even if a pearlite microstructure is formed, which coarsens the lamellar spacing. Therefore, the Mn content is 0.20 mass % or more and 1.00 mass % or less. The Mn content is preferably 0.20 mass % or more and 0.80 mass % or less.

P: 0.035 mass % or less

When the P content exceeds 0.035 mass %, the ductility of the steel is deteriorated. Therefore, the P content is 0.035 mass % or less. The P content is preferably 0.020 mass % or less. On the other hand, the lower limit of the P content is not particularly limited and may be 0 mass %. However, it is generally more than 0 mass % industrially. Because excessive reduction of P content causes an increase in refining cost, the P content is preferably 0.001 mass % or more from the viewpoint of economic efficiency.

S: 0.012 mass % or less

S is mainly present in the steel in the form of A type inclusions. When the S content exceeds 0.012 mass %, the amount of the inclusions is significantly increased, and at the same time coarse inclusions are formed. As a result, the cleanliness of the steel is deteriorated. Therefore, the S content is 0.012 mass % or less. The S content is preferably 0.010 mass % or less. The S content is more preferably 0.008 mass % or less. On the other hand, the lower limit of the S content is not particularly limited and may be 0 mass %. However, it is generally more than 0 mass % industrially. Because excessive reduction of S content causes an increase in refining cost, the S content is preferably 0.0005 mass % or more from the viewpoint of economic efficiency.

Cr: 0.40 mass % or more and 1.30 mass % or less

Cr raises the pearlite equilibrium transformation temperature of the steel and contributes to the refinement of the lamellar spacing, and at the same time, further strengthens the steel by solid solution strengthening. However, when the Cr content is less than 0.40 mass %, enough internal hardness cannot be obtained. On the other hand, when the Cr content is more than 1.30 mass %, the hardenability of the steel is increased, and martensite is likely to be formed.

When the manufacture is performed under conditions where no martensite is formed, pro-eutectoid cementite is formed at prior austenite grain boundaries. As a result, the wear resistance and the fatigue damage resistance are decreased. Therefore, the Cr content is 0.40 mass % or more and 1.30 mass % or less. The Cr content is preferably 0.60 mass % or more and 1.20 mass % or less.

$$0.30 \leq [\%\ Si]/10+[\%\ Mn]/6+[\%\ Cr]/3 \leq 0.55 \quad (1)$$

where [% M] is the content (mass %) of the element M in the chemical composition When the value calculated from the median part of the above formula (1) for Si content [% Si], Mn content [% Mn] and Cr content [% Cr] is less than 0.30, it is difficult to satisfy the requirement for the Vickers hardness of a region between a position where a depth from a surface of a rail head is 0.5 mm and a position where the depth is 25 mm (hereinafter also simply referred to as "surface layer region") of being in the range of 370 HV or more and less than 520 HV described later. In addition, when the value calculated from the median part of the above formula (1) exceeds 0.55, a martensite microstructure is formed in the surface layer region and the ductility and the toughness are decreased due to the high hardenability of Si, Mn, and Cr. Further, because the area ratio of a bainite microstructure is 20% or more, the wear resistance is also significantly decreased. Therefore, the Si, Mn, and Cr contents [% Si], [% Mn], and [% Cr] should satisfy the above formula (1). The value calculated from the median part of the above formula (1) is more preferably 0.35 or more and 0.50 or less.

The chemical composition of the rail of the present disclosure may optionally contain, in addition to the above components, either or both of at least one selected from the following Group A and at least one selected from the following Group B.

Group A: V: 0.30 mass % or less, Cu: 1.0 mass % or less, Ni: 1.0 mass % or less,
Nb: 0.05 mass % or less, and Mo: 0.5 mass % or less Group B: Al: 0.07 mass % or less, W: 1.0 mass % or less, B: 0.005 mass % or less, Ti: 0.05 mass % or less, and Sb: 0.05 mass % or less The following describes the reasons for specifying the contents of the elements of the above Group A and Group B.

V: 0.30 mass % or less

V forms carbonitrides in the steel and disperses and precipitates in the matrix, thereby improving the wear resistance of the steel. However, when the V content exceeds 0.30 mass %, the workability deteriorates and the manufacturing cost increases. In addition, when the V content exceeds 0.30 mass %, the alloy cost increases. As a result, the cost of the rail increases. Therefore, V may be contained with the upper limit being 0.30 mass %. Note that the V content is preferably 0.001 mass % or more in order to exhibit the effect of improving the wear resistance. The V content is more preferably in the range of 0.001 mass % or more and 0.15 mass % or less.

Cu: 1.0 mass % or less

Cu is an element capable of further strengthening the steel by solid solution strengthening, as with Cr. However, when the Cu content exceeds 1.0 mass %, Cu cracking is likely to occur. Therefore, when the chemical composition contains Cu, the Cu content is preferably 1.0 mass % or less. The Cu content is more preferably 0.005 mass % or more and 0.5 mass % or less.

Ni: 1.0 mass % or less.

Ni is an element that can increase the strength of the steel without deteriorating the ductility. In addition, in the case where the chemical composition contains Cu, it is preferable to add Ni because Cu cracking can be suppressed by the addition of Ni in combination with Cu. However, when the Ni content exceeds 1.0 mass %, the hardenability of the steel is further increased, martensite and out-of-range bainite are formed, and the wear resistance and the fatigue damage resistance tend to be decreased. Therefore, when Ni is contained, the Ni content is preferably 1.0 mass % or less. The Ni content is more preferably 0.005 mass % or more and 0.500 mass % or less.

Nb: 0.05 mass % or less

Nb precipitates as carbides by combining with C in the steel during and after the hot rolling for shaping the steel into a rail, which effectively reduces the size of pearlite colony. As a result, the wear resistance, the fatigue damage resistance, and the ductility are greatly improved, which greatly extends the service life of the rail with high internal hardness. However, when the Nb content exceeds 0.05 mass %, the effect of improving the wear resistance and the fatigue damage resistance is saturated, and the effect does not increase as the content increases. Therefore, Nb may be contained with the upper limit being 0.05 mass %. When the Nb content is less than 0.001 mass %, it is difficult to obtain a sufficient effect of extending the service life of the rail. Therefore, when Nb is contained, the Nb content is preferably 0.001 mass % or more. The Nb content is more preferably 0.001 mass % or more and 0.030 mass % or less.

Mo: 0.5 mass % or less

Mo is an element capable of further strengthening the steel by solid solution strengthening. However, when the Mo content exceeds 0.5 mass %, out-of-range bainite is formed in the steel, and the wear resistance is decreased. Therefore, when the chemical composition of the rail contains Mo, the Mo content is preferably 0.5 mass % or less. The Mo content is more preferably 0.005 mass % or more and 0.300 mass % or less.

Al: 0.07 mass % or less

Al is an element that can be added as a deoxidizer. However, when the Al content exceeds 0.07 mass %, a large amount of oxide-based inclusions is formed in the steel due to the high bonding strength between Al and oxygen. As a result, the ductility of the steel is decreased. Therefore, the Al content is preferably 0.07 mass % or less. On the other hand, the lower limit of the Al content is not particularly limited. However, it is preferably 0.001 mass % or more for deoxidation. The Al content is more preferably 0.001 mass % or more and 0.030 mass % or less.

W: 1.0 mass % or less

W precipitates as carbides during and after the hot rolling for shaping the steel into a rail shape, and improves the strength and the ductility of the rail by precipitation strengthening. However, when the W content exceeds 1.0 mass %, martensite is formed in the steel. As a result, the ductility is decreased. Therefore, when W is added, the W content is preferably 1.0 mass % or less. On the other hand, the lower limit of the W content is not particularly limited, yet the W content is preferably 0.001 mass % or more in order to exert the effect of improving the strength and the ductility. The W content is more preferably 0.005 mass % or more and 0.500 mass % or less.

B: 0.005 mass % or less

B precipitates as nitrides in the steel during and after the hot rolling for shaping the steel into a rail shape, and improves the strength and the ductility of the steel by precipitation strengthening. However, when the B content exceeds 0.005 mass %, martensite is formed. As a result, the ductility of the steel is decreased. Therefore, when B is contained, the B content is preferably 0.005 mass % or less. On the other hand, the lower limit of the B content is not particularly limited, yet the B content is preferably 0.001 mass % or more in order to exert the effect of improving the strength and the ductility. The B content is more preferably 0.001 mass % or more and 0.003 mass % or less.

Ti: 0.05 mass % or less

Ti precipitates as carbides, nitrides, or carbonitrides in the steel during and after the hot rolling for shaping the steel into a rail shape, and improves the strength and the ductility of the steel by precipitation strengthening. However, when the Ti content exceeds 0.05 mass %, coarse carbides, nitrides or carbonitrides are formed. As a result, the ductility of the steel is decreased. Therefore, when Ti is contained, the Ti content is preferably 0.05 mass % or less. On the other hand, the lower limit of the Ti content is not particularly limited, yet the Ti content is preferably 0.001 mass % or more in order to exert the effect of improving the strength and the ductility. The Ti content is more preferably 0.005 mass % or more and 0.030 mass % or less.

Sb: 0.05 mass % or less

Sb has a remarkable effect of preventing the decarburization of the steel when reheating the rail steel material in a heating furnace before the hot rolling. However, when the Sb content exceeds 0.05 mass %, the ductility and the toughness of the steel are adversely affected. Therefore, when Sb is contained, the Sb content is preferably 0.05 mass % or less. On the other hand, the lower limit of the Sb content is not particularly limited, yet the Sb content is preferably 0.001 mass % or more in order to exert the effect of reducing a decarburized layer. The Sb content is more preferably 0.005 mass % or more and 0.030 mass % or less.

The chemical composition of the steel as the material of the rail of the present disclosure contains the above components and Fe and inevitable impurities as the balance. The balance preferably consists of Fe and inevitable impurities. The present disclosure also includes rails that contain other trace elements within a range that does not substantially affect the effects of the present disclosure instead of a part of the balance Fe in the chemical composition of the present disclosure. As used herein, examples of the inevitable impurities include P, N, O, and the like. As described above, a P content up to 0.035 mass % is allowable. In addition, a N content up to 0.008 mass % is allowable, and an O content up to 0.004 mass % is allowable.

Next, the reasons for limiting the hardness and the steel microstructure of the rail of the present disclosure will be described. Vickers hardness of a region between a position where a depth from a surface of a rail head is 0.5 mm and a position where the depth is 25 mm (surface layer region): 370 HV or more and less than 520 HV When the Vickers hardness of the surface layer region of the rail head is less than 370 HV, the wear resistance of the steel is decreased, and the service life of the rail is shortened. On the other hand, when the Vickers hardness of the surface layer region is 520HV or more, martensite is formed, and the fatigue damage resistance of the steel is decreased. Therefore, the Vickers hardness of the surface layer region of the rail head is 370 HV or more and less than 500 HV. The Vickers hardness of the surface layer region of the rail head is specified because the performance of the surface layer region of the rail head controls the performance of the rail. The Vickers hardness of the surface layer region is preferably 400HV or more and less than 480 HV.

Steel microstructure of the surface layer region: a total area ratio of a pearlite microstructure and a bainite microstructure is 98% or more, and an area ratio of a bainite microstructure is more than 5% and less than 20%

The wear resistance and the fatigue damage resistance of the steel vary greatly depending on the microstructure, and a pearlite microstructure and a bainite microstructure have superior wear resistance and fatigue damage resistance compared to a martensitic microstructure of the same hardness. In order to stably improve these properties required for the rail material, it is necessary to secure a total area ratio of a pearlite microstructure and a bainite microstructure of 98% or more in the surface layer region described above. It is more preferably 99% or more and may be 100%. The residual microstructure other than the pearlite microstructure and the bainite microstructure is martensite, cementite, or the like. However, these microstructures are preferably as few as possible.

Further, since a bainite microstructure is more easily worn than a pearlite microstructure, it has the effect of improving the conformability when a wheel is in contact with the rail at an initial stage of use. If the area ratio of the bainite microstructure is less than 5% in the surface layer region described above, it is difficult to exert this effect effectively. On the other hand, if the area ratio is 20% or more, the wear resistance is decreased. Therefore, the area ratio of the bainite microstructure should be more than 5% and less than 20%. It is more preferably more than 5% and 10% or less.

Next, a method of manufacturing the rail of the present disclosure will be described.

That is, the rail of the present disclosure can be manufactured by subjecting a steel material having the chemical composition described above to hot rolling where a rolling finish temperature is 850° C. or higher and 950° C. or lower, then to cooling where a cooling start temperature is equal to or higher than a pearlite transformation start temperature, a cooling stop temperature is 350° C. or higher and 600° C. or lower, and a cooling rate is 2° C./s or higher and 10° C./s or lower. The following describes the reasons why the rolling finish temperature in the hot rolling and the cooling conditions after the hot rolling are set in the above ranges.

Finish temperature of hot rolling: 850° C. or higher and 950° C. or lower

The hot rolling is performed to shape the steel material into a rail shape. If the rolling finish temperature during the hot rolling is lower than 850° C., then the rolling is performed in an austenite low temperature range. As a result, not only processing strain is introduced into austenite crystal grains, but also the elongation degree of austenite crystal grains becomes remarkable. Although the introduction of dislocations and an increase in the austenite grain boundary area increase the number of pearlite nucleation sites and reduce the size of pearlite colony, the increase in the number of pearlite nucleation sites raises the pearlite transformation start temperature and coarsens the lamellar spacing of pearlite layers, which significantly decreases the wear resistance. On the other hand, if the rolling finish temperature exceeds 950° C., the austenite crystal grains are coarsened, which coarsens the size of finally obtained pearlite colony and decreases the fatigue damage resistance. Therefore, the rolling finish temperature is 850° C. or higher and 950° C. or lower. It is preferably 880° C. or higher and 930° C. or lower.

Cooling start temperature after hot rolling: equal to or higher than a pearlite transformation start temperature; cooling stop temperature: 350° C. or higher and 600° C. or lower; cooling rate: 2° C./s or higher and 10° C./s or lower By subjecting the steel material after the hot rolling to cooling with the cooling start temperature being equal to or higher than a pearlite transformation start temperature, it is possible to obtain a rail having the hardness and the steel microstructure described above. In the case where the start temperature of the accelerated cooling is below the pearlite transformation start temperature or the cooling rate during the accelerated cooling is lower than 2° C./s, the lamellar spacing of the pearlite microstructure is coarsened and the internal hardness of the rail head is decreased. On the other hand, in the case where the cooling rate exceeds 10° C./s, a martensite microstructure or a bainite microstructure having an area ratio of 20% or more is formed, and the service life of the rail is shortened. Therefore, the cooling rate is in the range of 2° C./s or higher and 10° C./s or lower. It is preferably 2.5° C./s or higher and 7.5° C./s or lower. Although the pearlite transformation start temperature varies depending on the cooling rate, it refers to the equilibrium transformation temperature in the present disclosure. In the composition range of the present disclosure, a cooling rate of the above range may be adopted as a start when the temperature is 720° C. or higher.

Then, if the cooling stop temperature of the accelerated cooling is lower than 350° C., the cooling time in a low temperature range is increased, which lowers the productivity and increases the manufacturing cost of the rail. In addition, a bainite microstructure having an area ratio of 20% or more is formed, and the service life of the rail is shortened. On the other hand, if the cooling stop temperature of the accelerated cooling exceeds 600° C., the cooling of the inside of the above-described surface layer region of the rail head is stopped before the pearlite transformation or during the pearlite transformation, which coarsens the lamellar spacing of the pearlite microstructure and shortens the service life of the rail. Therefore, the cooling stop temperature is 350° C. or higher and 600° C. or lower. It is preferably 400° C. or higher and 550° C. or lower.

EXAMPLES

The following describes the structures and function effects of the present disclosure in more detail, by way of examples. Note that the present disclosure is not restricted by any means to these examples and may be changed appropriately within the range conforming to the purpose of the present disclosure, all of such changes being included within the technical scope of the present disclosure.

Steel materials having the chemical compositions listed in Table 1 were subjected to hot rolling and, after the hot rolling, to cooling under the conditions listed in Table 2 to prepare rail materials. The cooling was performed only on a rail head, and it was allowed to cool after the cooling. The rolling finish temperature in Table 2 is a value obtained by measuring the temperature of the rail head side surface on the entrance side of a final rolling mill with a radiation thermometer. The cooling stop temperature is a value obtained by measuring the temperature of the rail head side surface layer with a radiation thermometer when the cooling stops. The cooling rate (° C./s) is obtained by converting the temperature change from the start of cooling to the stop of cooling into a value of per unit time (second). Note that the cooling start temperature in all examples is 720° C. or higher, which is equal to or higher than a pearlite transformation start temperature.

TABLE 1

| Steel | Chemical composition (mass %) | | | | | | | | | | |
|---|---|---|---|---|---|---|---|---|---|---|---|
| No. | C | Si | Mn | P | S | Cr | V | Cu | Ni | Nb | Mo |
| 1 | 0.79 | 0.15 | 0.92 | 0.012 | 0.006 | 0.16 | — | — | — | — | — |
| 2 | 0.84 | 0.51 | 0.60 | 0.014 | 0.007 | 0.74 | — | — | — | — | — |
| 3 | 0.71 | 1.58 | 0.48 | 0.013 | 0.010 | 0.95 | — | — | — | — | — |
| 4 | 0.82 | 1.23 | 0.21 | 0.0.16 | 0.009 | 0.58 | — | — | — | — | — |
| 5 | 0.81 | 0.94 | 0.54 | 0.017 | 0.005 | 0.76 | — | — | — | — | — |
| 6 | 0.78 | 0.74 | 0.98 | 0.010 | 0.004 | 0.42 | — | — | — | — | — |
| 7 | 0.80 | 0.55 | 0.34 | 0.015 | 0.011 | 1.27 | — | — | — | — | — |
| 8 | 0.83 | 1.50 | 0.37 | 0.009 | 0.006 | 0.75 | — | — | — | — | — |
| 9 | 0.79 | 0.65 | 0.82 | 0.011 | 0.005 | 0.56 | — | — | — | — | — |
| 10 | 0.82 | 1.30 | 0.25 | 0.013 | 0.004 | 1.01 | — | — | — | — | — |
| 11 | 0.80 | 0.88 | 0.47 | 0.016 | 0.003 | 0.80 | — | — | — | — | — |
| 12 | 0.85 | 1.05 | 0.58 | 0.021 | 0.004 | 0.63 | — | — | — | — | — |
| 13 | 0.79 | 1.55 | 0.30 | 0.034 | 0.009 | 1.00 | — | — | — | — | — |
| 14 | 0.73 | 0.52 | 0.67 | 0.007 | 0.007 | 1.15 | — | — | — | — | — |
| 15 | 0.83 | 0.79 | 0.25 | 0.010 | 0.006 | 0.54 | — | — | — | — | — |
| 16 | 0.81 | 1.25 | 0.39 | 0.009 | 0.005 | 0.88 | 0.11 | — | — | 0.017 | — |
| 17 | 0.80 | 0.90 | 0.55 | 0.011 | 0.004 | 1.01 | — | 0.28 | 0.13 | — | — |
| 18 | 0.77 | 1.21 | 0.29 | 0.024 | 0.008 | 0.99 | — | — | — | — | 0.21 |
| 19 | 0.83 | 0.83 | 0.60 | 0.013 | 0.006 | 0.70 | — | — | — | — | — |
| 20 | 0.79 | 1.02 | 0.73 | 0.018 | 0.005 | 0.78 | — | — | — | — | — |
| 21 | 0.81 | 0.75 | 0.40 | 0.015 | 0.007 | 0.93 | — | — | — | — | 0.37 |
| 22 | 0.68 | 0.53 | 0.54 | 0.016 | 0.004 | 0.46 | — | — | — | — | — |
| 23 | 0.87 | 1.25 | 0.42 | 0.017 | 0.009 | 0.59 | — | — | — | — | — |
| 24 | 0.80 | 0.49 | 0.57 | 0.015 | 0.008 | 0.42 | — | — | — | — | — |
| 25 | 0.83 | 1.63 | 0.84 | 0.011 | 0.005 | 1.03 | — | — | — | — | — |
| 26 | 0.81 | 0.64 | 0.18 | 0.024 | 0.006 | 0.75 | — | — | — | — | — |
| 27 | 0.79 | 1.00 | 1.01 | 0.020 | 0.011 | 0.86 | — | — | — | — | — |
| 28 | 0.80 | 0.77 | 0.59 | 0.036 | 0.009 | 0.69 | — | — | — | — | — |
| 29 | 0.82 | 0.78 | 0.65 | 0.017 | 0.013 | 1.00 | — | — | — | — | — |
| 30 | 0.85 | 0.88 | 0.49 | 0.013 | 0.006 | 0.38 | — | — | — | — | — |
| 31 | 0.81 | 0.57 | 0.25 | 0.011 | 0.007 | 1.32 | — | — | — | — | — |
| 32 | 0.85 | 0.55 | 0.35 | 0.015 | 0.012 | 0.40 | — | — | — | — | — |
| 33 | 0.83 | 0.61 | 0.21 | 0.015 | 0.025 | 0.59 | — | — | — | — | — |
| 34 | 0.84 | 1.28 | 0.68 | 0.012 | 0.009 | 1.25 | — | — | — | — | — |
| 35 | 0.80 | 0.60 | 1.00 | 0.015 | 0.025 | 1.00 | — | — | — | — | — |

TABLE 1-continued

| Steel No. | Chemical composition (mass %) Al | W | B | Ti | Sb | [% Si]/10 + [% Mn]/6 + [% Cr]/3 | Remarks |
|---|---|---|---|---|---|---|---|
| 1 | — | — | — | — | — | 0.22 | Reference material |
| 2 | — | — | — | — | — | 0.40 | Conforming steel |
| 3 | — | — | — | — | — | 0.55 | |
| 4 | — | — | — | — | — | 0.35 | |
| 5 | — | — | — | — | — | 0.44 | |
| 6 | — | — | — | — | — | 0.38 | |
| 7 | — | — | — | — | — | 0.54 | |
| 8 | — | — | — | — | — | 0.46 | |
| 9 | — | — | — | — | — | 0.39 | |
| 10 | — | — | — | — | — | 0.51 | |
| 11 | — | — | — | — | — | 0.43 | |
| 12 | — | — | — | — | — | 0.41 | |
| 13 | — | — | — | — | — | 0.54 | |
| 14 | — | — | — | — | — | 0.55 | |
| 15 | — | — | — | — | — | 0.30 | |
| 16 | — | — | — | — | — | 0.48 | |
| 17 | 0.015 | — | — | — | — | 0.52 | |
| 18 | — | — | — | — | — | 0.50 | |
| 19 | — | 0.19 | — | — | 0.02 | 0.42 | |
| 20 | — | — | 0.004 | 0.02 | — | 0.48 | |
| 21 | — | — | — | — | 0.04 | 0.45 | |
| 22 | — | — | — | — | — | 0.30 | Comparative steel |
| 23 | — | — | — | — | — | 0.39 | |
| 24 | — | — | — | — | — | 0.28 | |
| 25 | — | — | — | — | — | 0.65 | |
| 26 | — | — | — | — | — | 0.34 | |
| 27 | — | — | — | — | — | 0.56 | |
| 28 | — | — | — | — | — | 0.41 | |
| 29 | — | — | — | — | — | 0.52 | |
| 30 | — | — | — | — | — | 0.30 | |
| 31 | — | — | — | — | — | 0.54 | |
| 32 | — | — | — | — | — | 0.25 | |
| 33 | — | — | — | — | — | 0.29 | |
| 34 | — | — | — | — | — | 0.66 | |
| 35 | — | — | — | — | — | 0.56 | |

*1 The underline indicates outside the applicable range.

TABLE 2

| Test No. | Steel No. | Rolling finish temperature [° C.] | Cooling stop temperature [° C.] | Cooling rate [° C./s] |
|---|---|---|---|---|
| 1 | 1 | 900 | 550 | 3.4 |
| 2 | 2 | 925 | 500 | 5.8 |
| 3 | 3 | 850 | 525 | 2.2 |
| 4 | 4 | 875 | 450 | 4.7 |
| 5 | 5 | 900 | 550 | 5.5 |
| 6 | 6 | 900 | 475 | 6.2 |
| 7 | 7 | 850 | 575 | 4.0 |
| 8 | 8 | 950 | 500 | 5.9 |
| 9 | 9 | 925 | 475 | 2.8 |
| 10 | 10 | 900 | 550 | 3.6 |
| 11 | 11 | 925 | 450 | 5.0 |
| 12 | 12 | 875 | 500 | 4.1 |
| 13 | 13 | 925 | 575 | 3.0 |
| 14 | 14 | 900 | 525 | 2.5 |
| 15 | 15 | 900 | 400 | 8.8 |
| 16 | 16 | 875 | 500 | 3.4 |
| 17 | 17 | 925 | 525 | 4.1 |
| 18 | 18 | 850 | 550 | 5.3 |
| 19 | 19 | 950 | 475 | 6.6 |
| 20 | 20 | 925 | 500 | 5.0 |
| 21 | 21 | 900 | 525 | 4.7 |
| 22 | 22 | 875 | 500 | 8.0 |
| 23 | 23 | 900 | 525 | 2.1 |
| 24 | 24 | 925 | 450 | 5.5 |
| 25 | 25 | 900 | 500 | 6.9 |
| 26 | 26 | 950 | 375 | 7.0 |
| 27 | 27 | 875 | 525 | 8.8 |

TABLE 2-continued

| Test No. | Steel No. | Rolling finish temperature [° C.] | Cooling stop temperature [° C.] | Cooling rate [° C./s] |
|---|---|---|---|---|
| 28 | 28 | 925 | 525 | 4.8 |
| 29 | 29 | 925 | 500 | 4.6 |
| 30 | 30 | 900 | 450 | 8.1 |
| 31 | 31 | 875 | 550 | 2.9 |
| 32 | 32 | 850 | 400 | 6.8 |
| 33 | 33 | 900 | 425 | 7.6 |
| 34 | 34 | 950 | 500 | 5.1 |
| 35 | 35 | 900 | 500 | 5.8 |
| 36 | 4 | 960 | 475 | 9.4 |
| 37 | 4 | 840 | 500 | 6.0 |
| 38 | 10 | 900 | 340 | 8.4 |
| 39 | 10 | 900 | 610 | 3.0 |
| 40 | 13 | 925 | 550 | 1.9 |
| 41 | 13 | 900 | 400 | 10.2 |

*1 The underline indicates outside the applicable range.

The rails thus obtained were evaluated in terms of hardness of rail head, steel microstructure, wear resistance, and fatigue damage resistance. The following describes the details of each evaluation.

Hardness of Rail Head

The Vickers hardness of the surface layer region (a region between a position where the depth from the surface of the rail head was 0.5 mm and a position where the depth was 25 mm) illustrated in FIG. 1 was measured at a load of 98 N and a pitch of 0.5 mm in the depth direction, and the maximum and minimum values of the hardness were obtained.

Steel Microstructure of Rail Head

Test pieces were collected near the surface of the rail head (of depth of about 1 mm) and at positions of depths of 5 mm, 10 mm, 15 mm, 20 mm, and 25 mm, respectively. Each of the collected test pieces was corroded with nital after polishing, a cross section of each test piece was observed under an optical microscope at 400 times to identify the type of microstructure, and the area ratio of each of a pearlite microstructure and a bainite microstructure was obtained by image interpretation. The area ratio of each microstructure (pearlite microstructure and bainite microstructure) in the surface layer region was evaluated by the ratio in percentage of the total area observed as such microstructures to the total area value observed at each position.

Wear Resistance

Figure 2A:
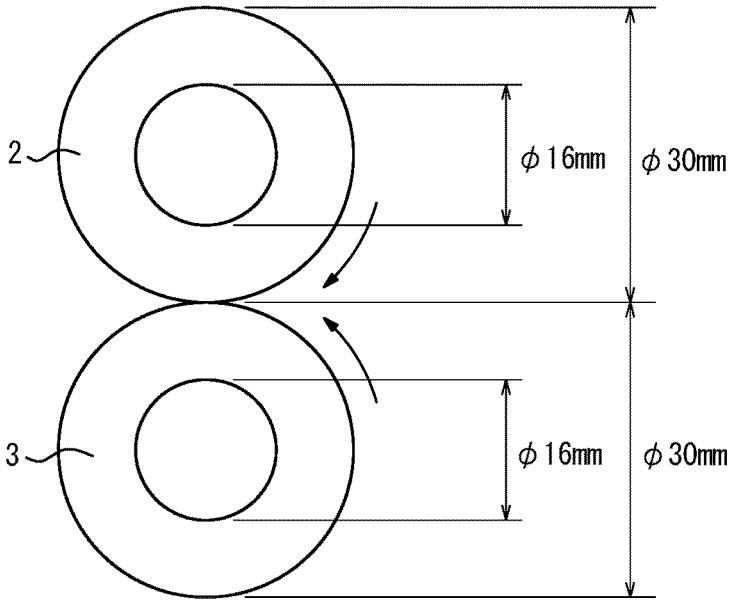
FIG. 2A is a plan view illustrating a Nishihara type wear test piece for evaluating wear resistance.
Figure 2B:
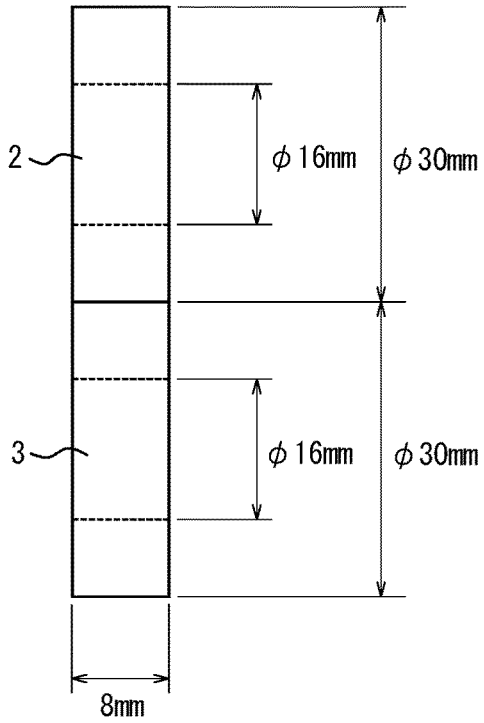
FIG. 2B is a side view illustrating the Nishihara type wear test piece for evaluating wear resistance.
Figure 3:
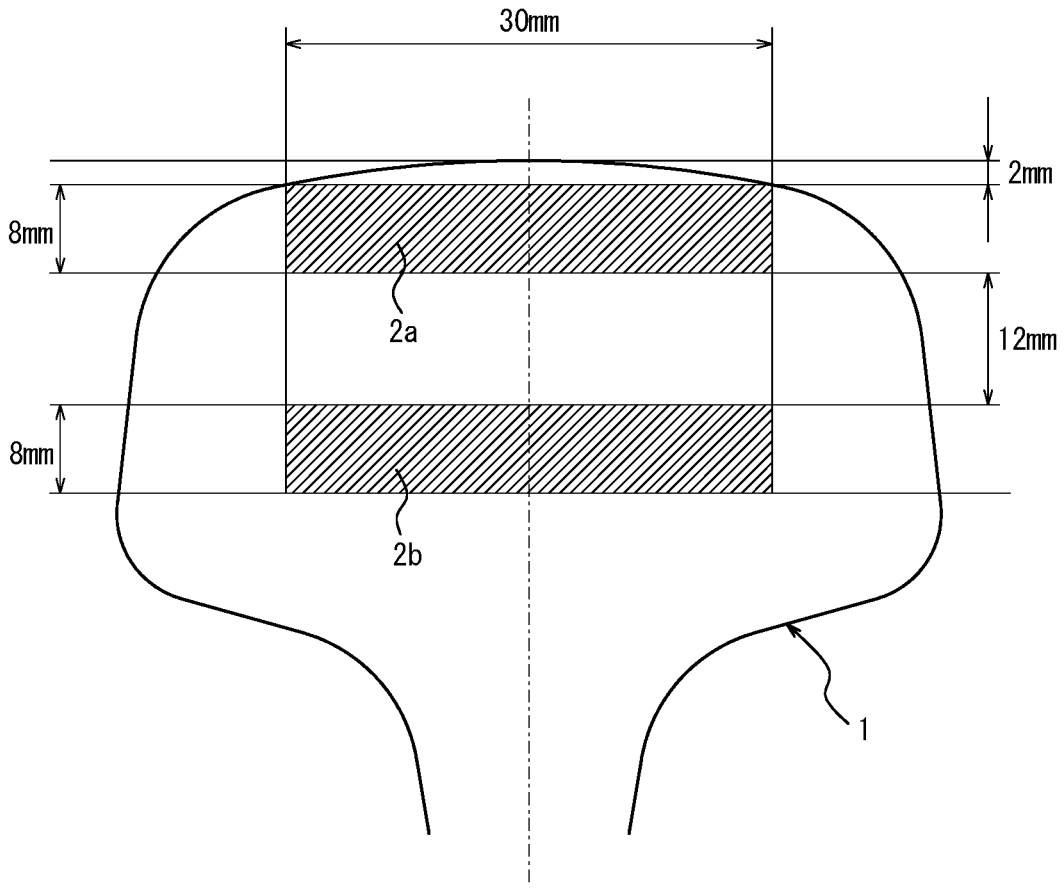
FIG. 3 is a cross-sectional view of a rail head indicating the collecting positions of Nishihara type wear test pieces.

It is most desirable to actually lay the rail to evaluate the wear resistance, yet this requires a long testing time. Therefore, in the present disclosure, the wear resistance was evaluated by a comparative test in which actual contact conditions between a rail and a wheel were simulated using a Nishihara type wear test apparatus that enables wear resistance evaluation in a short period of time. Specifically, a Nishihara type wear test piece 2 having an outer diameter of 30 mm as illustrated in FIGS. 2A and 2B was collected from the rail head, and the test piece 2 was brought into contact with a tire test piece 3 and rotated as illustrated in FIGS. 2A and 2B to conduct the test. The arrows in FIG. 2A indicate the rotation directions of the Nishihara type wear test piece 2 and the tire test piece 3, respectively. The tire test piece was obtained by collecting a round bar having a diameter of 32 mm from the head of a normal rail according to JIS standard E1101 where the Vickers hardness (load: 98N) was 390 HV, subjecting the round bar to heat treatment so that the microstructure turned into a tempered martensite microstructure, and then processing it into the shape of the tire test piece 3 illustrated in FIGS. 2A and 2B. The Nishihara type wear test pieces 2 were collected from two locations in the rail head 1 as illustrated in FIG. 3. The one collected from the surface layer region of the rail head 1 was a Nishihara type wear test piece 2*a*, and the one collected from the inner side than the surface layer region was a Nishihara type wear test piece 2*b*. The center in the longitudinal direction of the Nishihara type wear test piece 2*b* collected from the inside of the rail head 1 was located at a depth of 24 mm or more and 26 mm or less (average value: 25 mm) from the upper surface of the rail head 1. The test was conducted under dry ambient conditions, and the amount of wear was measured after 100,000 rotations under conditions of a contact pressure of 1.6 GPa, a slip ratio of −10%, and a rotational speed of 675 rpm (tire test piece: 750 rpm). A heat-treated pearlite steel rail was used as a reference steel material when comparing the amounts of wear, and it was determined that the wear resistance was improved when the amount of wear was 10% or more less than that of the reference material. The wear resistance improvement margin was calculated using the sum of the amounts of wear of the Nishihara type wear test piece 2*a* and the Nishihara type wear test piece 2*b* by {(amount of wear of reference material−amount of wear of test material)/(amount of wear of reference material)}×100.

Fatigue Damage Resistance

Figure 4A:
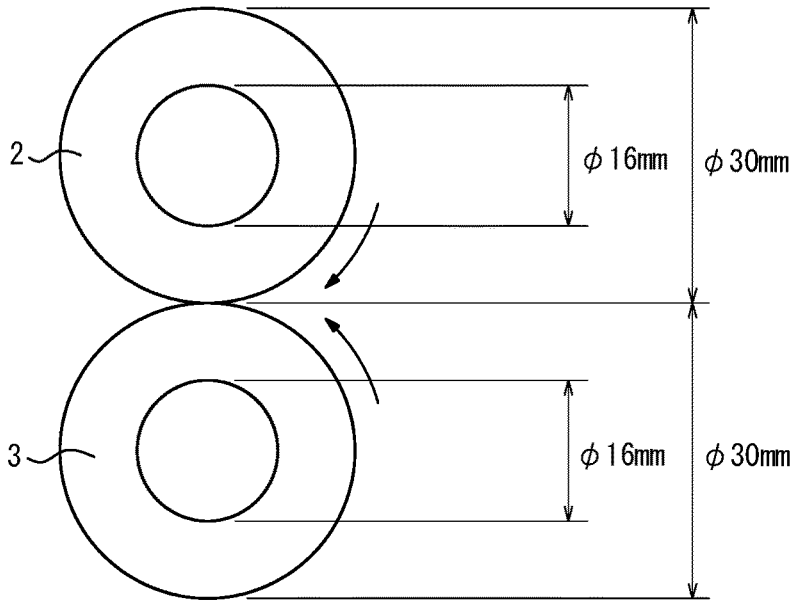
FIG. 4A is a plan view illustrating a Nishihara type wear test piece for evaluating fatigue damage resistance.
Figure 4B:
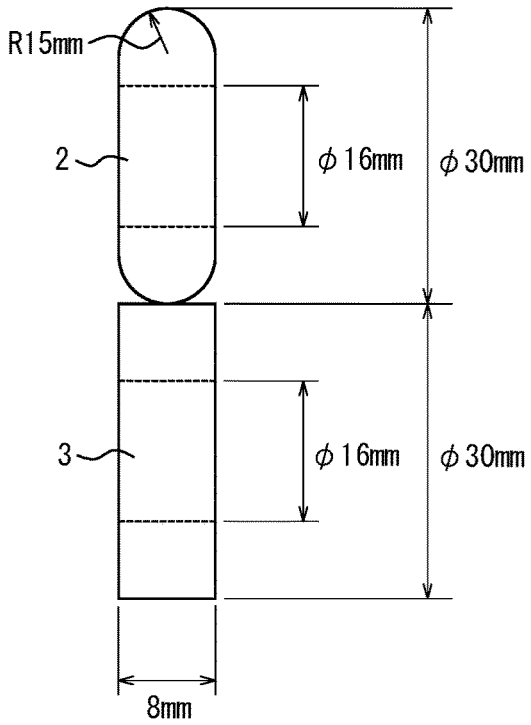
FIG. 4B is a side view illustrating the Nishihara type wear test piece for evaluating fatigue damage resistance.

With respect to the fatigue damage resistance, a Nishihara type wear test piece 2 having a diameter of 30 mm whose contact surface was a curved surface having a radius of curvature of 15 mm was collected from the rail head, and the test piece 2 was brought into contact with a tire test piece 3 and rotated as illustrated in FIGS. 4A and 4B to conduct the test. The arrows in FIG. 4A indicate the rotation directions of the Nishihara type wear test piece 2 and the tire test piece 3, respectively. The Nishihara type wear test pieces 2 were collected from two locations in the rail head 1 as illustrated in FIG. 3. The Nishihara type wear test pieces 2 and the tire test piece 3 were collected at the same positions as described above, and thus the description thereof is omitted. The test was conducted under oil lubrication conditions, where the contact pressure was 2.4 GPa, the slip ratio was −20%, and the rotational speed was 600 rpm (tire test piece: 750 rpm). The surface of the test piece was observed every 25,000 rotations, and the number of rotations at the time when a crack of 0.5 mm or more occurred was taken as the fatigue damage life. A heat-treated pearlite steel rail was used as a reference steel material when comparing the length of fatigue damage life, and it was determined that the fatigue damage resistance was improved when the fatigue damage time was 10% or more longer than that of the reference material. The fatigue damage resistance improvement margin was calculated using the total value of the numbers of rotations until the occurrence of fatigue damage in the Nishihara type wear test piece 2*a* and the Nishihara type wear test piece 2*b* by

[{(number of rotations until occurrence of fatigue damage in test material)−(number of rotations until occurrence of fatigue damage in reference material)}/(number of rotations until occurrence of fatigue damage in reference material)]×100

The results of the evaluations are listed in Table 3. The test results of the rail materials prepared with the manufacturing method within the scope of the present disclosure (the hot-rolling finish temperature, and the cooling rate and the cooling stop temperature after the hot rolling) using a conforming steel satisfying the chemical composition of the present disclosure (Test Nos. 2 to 21 in Table 3) indicate that both the wear resistance and the fatigue damage resistance were improved by 10% or more with respect to the reference material. On the other hand, for Comparative Examples (Test Nos. 22 to 41 in Table 3), where the chemical composition of the rail material did not satisfy the conditions of the present disclosure or the manufacturing method within the scope of the present disclosure (the hot-rolling finish temperature, and the cooling rate and the cooling stop temperature after the hot rolling) was not used and consequently the examples did not satisfy the steel microstructure of the present disclosure, the improvement margin of at least one of the wear resistance and the fatigue damage resistance with respect to the reference material was lower than that of Examples.

TABLE 3

| Test No. | Steel No. | Microstructure*2 | Pearlite + bainite area ratio [%] | Bainite area ratio [%] | Railhead surface layer: Minimum hardness [HV] | Railhead surface layer: Maximum hardness [HV] | Railhead surface layer: Amount of wear [g] | Railhead surface layer: Number of rotations until occurrence of fatigue damage [× $10^5$] |
|---|---|---|---|---|---|---|---|---|
| 1 | 1 | P | 100 | 0 | 342 | 383 | 1.45 | 7.50 |
| 2 | 2 | P + B | 100 | 11 | 413 | 462 | 1.25 | 8.50 |
| 3 | 3 | P + B | 100 | 18 | 405 | 473 | 1.30 | 9.50 |
| 4 | 4 | P + B | 100 | 8 | 416 | 479 | 1.21 | 8.50 |
| 5 | 5 | P + B | 100 | 13 | 420 | 468 | 1.27 | 8.75 |
| 6 | 6 | P + B | 100 | 10 | 409 | 455 | 1.26 | 8.50 |
| 7 | 7 | P + B + M | 99 | 17 | 418 | 460 | 1.36 | 8.75 |
| 8 | 8 | P + B | 100 | 11 | 425 | 495 | 1.25 | 8.75 |
| 9 | 9 | P + B | 100 | 10 | 406 | 470 | 1.28 | 8.50 |
| 10 | 10 | P + B | 100 | 14 | 428 | 481 | 1.26 | 9.00 |
| 11 | 11 | P + B | 100 | 13 | 415 | 469 | 1.30 | 8.75 |
| 12 | 12 | P + B | 100 | 11 | 419 | 470 | 1.26 | 8.50 |
| 13 | 13 | P + B + M | 99 | 16 | 432 | 493 | 1.23 | 9.00 |
| 14 | 14 | P + B | 100 | 19 | 410 | 460 | 1.32 | 9.50 |
| 15 | 15 | P + B | 100 | 6 | 386 | 446 | 1.24 | 8.50 |
| 16 | 16 | P + B | 100 | 10 | 423 | 467 | 1.29 | 8.50 |
| 17 | 17 | P + B | 100 | 17 | 430 | 471 | 1.30 | 9.00 |
| 18 | 18 | P + B | 100 | 16 | 418 | 465 | 1.32 | 8.75 |
| 19 | 19 | P + B | 100 | 13 | 426 | 470 | 1.26 | 8.50 |
| 20 | 20 | P + B | 100 | 14 | 422 | 476 | 1.28 | 8.25 |
| 21 | 21 | P + B | 100 | 13 | 420 | 464 | 1.30 | 8.50 |
| 22 | 22 | P + B | 100 | 6 | 333 | 401 | 1.42 | 7.75 |
| 23 | 23 | P + B + θ | 96 | 9 | 420 | 474 | 1.31 | 7.75 |
| 24 | 24 | P + B | 100 | 2 | 395 | 438 | 1.38 | 7.75 |
| 25 | 25 | P + B + M | 97 | 34 | 446 | 524 | 1.43 | 7.75 |
| 26 | 26 | P + B | 100 | 10 | 398 | 430 | 1.37 | 7.75 |
| 27 | 27 | P + B + M | 97 | 24 | 425 | 538 | 1.40 | 7.50 |
| 28 | 28 | P + B | 100 | 7 | 419 | 464 | 1.33 | 7.75 |
| 29 | 29 | P + B + M | 99 | 15 | 421 | 463 | 1.31 | 7.50 |
| 30 | 30 | P + B | 100 | 7 | 396 | 428 | 1.39 | 8.25 |
| 31 | 31 | P + B + θ | 97 | 18 | 418 | 459 | 1.35 | 7.75 |
| 32 | 32 | P + B | 100 | 2 | 367 | 426 | 1.33 | 7.75 |
| 33 | 33 | P + B | 100 | 3 | 392 | 440 | 1.30 | 7.75 |
| 34 | 34 | P + B + M | 95 | 38 | 449 | 548 | 1.43 | 9.25 |
| 35 | 35 | P + B + M | 98 | 21 | 433 | 512 | 1.40 | 8.75 |
| 36 | 4 | P + B + M | 99 | 10 | 430 | 522 | 1.26 | 8.00 |
| 37 | 4 | P + B | 100 | 8 | 366 | 445 | 1.44 | 8.00 |
| 38 | 10 | P + B + M | 96 | 25 | 410 | 526 | 1.41 | 7.25 |
| 39 | 10 | P + B | 100 | 1 | 392 | 439 | 1.40 | 8.00 |
| 40 | 13 | P + B | 100 | 1 | 400 | 441 | 1.39 | 7.75 |
| 41 | 13 | P + B + M | 95 | 30 | 452 | 534 | 1.42 | 6.75 |

| Test No. | Steel No. | 25 mm inside rail: Amount of wear [g] | 25 mm inside rail: Number of rotations until occurrence of fatigue damage [× $10^5$] | Wear resistance [%] | Fatigue damage resistance [%] | Remarks |
|---|---|---|---|---|---|---|
| 1 | 1 | 1.68 | 6.25 | — | — | Reference material |
| 2 | 2 | 1.39 | 7.50 | 15.7 | 16.4 | Example |
| 3 | 3 | 1.45 | 7.25 | 12.1 | 21.8 | |
| 4 | 4 | 1.35 | 7.50 | 18.2 | 16.4 | |
| 5 | 5 | 1.40 | 7.75 | 14.7 | 20.0 | |
| 6 | 6 | 1.37 | 7.25 | 16.0 | 14.5 | |
| 7 | 7 | 1.46 | 7.75 | 10.0 | 20.0 | |
| 8 | 8 | 1.38 | 8.00 | 16.0 | 21.8 | |
| 9 | 9 | 1.42 | 7.50 | 13.7 | 16.4 | |
| 10 | 10 | 1.40 | 8.00 | 15.0 | 23.6 | |
| 11 | 11 | 1.43 | 7.25 | 12.8 | 16.4 | |
| 12 | 12 | 1.46 | 7.25 | 13.1 | 14.5 | |
| 13 | 13 | 1.39 | 8.25 | 16.3 | 25.5 | |
| 14 | 14 | 1.48 | 7.50 | 10.5 | 23.6 | |
| 15 | 15 | 1.39 | 7.25 | 16.0 | 14.5 | |
| 16 | 16 | 1.45 | 7.25 | 12.5 | 14.5 | |
| 17 | 17 | 1.46 | 7.75 | 11.8 | 21.8 | |
| 18 | 18 | 1.48 | 7.25 | 10.5 | 16.4 | |
| 19 | 19 | 1.41 | 7.00 | 14.7 | 12.7 | |
| 20 | 20 | 1.40 | 7.50 | 14.4 | 14.5 | |
| 21 | 21 | 1.42 | 7.00 | 13.1 | 12.7 | |
| 22 | 22 | 1.62 | 6.25 | 2.9 | 1.8 | Comparative |
| 23 | 23 | 1.45 | 6.75 | 11.8 | 5.5 | Example |
| 24 | 24 | 1.50 | 6.50 | 8.0 | 3.6 | |

TABLE 3-continued

| | | | | | |
|---|---|---|---|---|---|
| 25 | 25 | 1.58 | 7.25 | 3.8 | 9.1 |
| 26 | 26 | 1.46 | 7.00 | 9.6 | 7.3 |
| 27 | 27 | 1.52 | 7.00 | 6.7 | 5.5 |
| 28 | 28 | 1.48 | 7.25 | 10.2 | 9.1 |
| 29 | 29 | 1.49 | 6.75 | 10.5 | 3.6 |
| 30 | 30 | 1.47 | 6.75 | 8.6 | 9.1 |
| 31 | 31 | 1.42 | 6.50 | 11.5 | 3.6 |
| 32 | 32 | 1.45 | 6.50 | 11.2 | 3.6 |
| 33 | 33 | 1.44 | 6.75 | 12.5 | 5.5 |
| 34 | 34 | 1.65 | 7.75 | 1.6 | 23.6 |
| 35 | 35 | 1.59 | 7.75 | 4.5 | 20.0 |
| 36 | 4 | 1.40 | 7.00 | 15.0 | 9.1 |
| 37 | 4 | 1.56 | 6.50 | 4.2 | 5.5 |
| 38 | 10 | 1.53 | 7.00 | 6.1 | 3.6 |
| 39 | 10 | 1.55 | 7.00 | 5.8 | 9.1 |
| 40 | 13 | 1.51 | 7.25 | 7.3 | 9.1 |
| 41 | 13 | 1.63 | 7.25 | 2.6 | 1.8 |

*1 The underline indicates outside the applicable range.
*2 P: pearlite, B: bainite, M: martensite, θ: pro-eutectoid cementite

REFERENCE SIGNS LIST

1 rail head
2 Nishihara type wear test piece collected from a pearlite steel rail
2*a* Nishihara type wear test piece collected from the surface layer region of the rail head
2*b* Nishihara type wear test piece collected from the inside of the rail head
3 tire test piece

The invention claimed is:

1. A rail comprising a chemical composition containing
C: 0.70 mass % or more and 0.85 mass % or less,
Si: 0.79 mass % or more and 1.20 mass % or less,
Mn: 0.20 mass % or more and 1.00 mass % or less,
P: 0.035 mass % or less,
S: 0.012 mass % or less,
Cr: 0.40 mass % or more and 1.30 mass % or less, and
at least one selected from the group consisting of
Nb: 0.017 mass % or more and 0.05 mass % or less,
Al: 0.015 mass % or more and 0.07 mass % or less, and
Ti: 0.02 mass % or more and 0.05 mass % or less,
where the chemical composition satisfies the following formula (1)

$$0.30 \leq [\%\ Si]/10+[\%\ Mn]/6+[\%\ Cr]/3 \leq 0.55 \quad (1)$$

where [% M] is the content in mass % of the element M in the chemical composition, the balance being Fe and inevitable impurities, wherein
Vickers hardness of a region between a position where a depth from a surface of a rail head is 0.5 mm and a position where the depth is 25 mm is 370 HV or more and less than 520 HV, a total area ratio of a pearlite microstructure and a bainite microstructure in the region is 98% or more, and an area ratio of the bainite microstructure in the region is more than 5% and less than 20%.

2. The rail according to claim 1, wherein the chemical composition further contains at least one selected from the group consisting of
V: 0.30 mass % or less,
Cu: 1.0 mass % or less,
Ni: 1.0 mass % or less, and
Mo: 0.5 mass % or less.

3. The rail according to claim 1, wherein the chemical composition further contains at least one selected from the group consisting of
W: 1.0 mass % or less,
B: 0.005 mass % or less, and
Sb: 0.05 mass % or less.

4. The rail according to claim 2, wherein the chemical composition further contains at least one selected from the group consisting of
W: 1.0 mass % or less,
B: 0.005 mass % or less, and
Sb: 0.05 mass % or less.

5. A method of manufacturing a rail, comprising subjecting a steel material having the chemical composition according to claim 1 to hot rolling where a finish temperature is 850° C. or higher and 950° C. or lower, then to cooling where a cooling start temperature is equal to or higher than a pearlite transformation start temperature, a cooling stop temperature is 350° C. or higher and 600° C. or lower, and a cooling rate is 2° C./s or higher and 10° C./s or lower; thereby producing the rail according to claim 1.

6. A method of manufacturing a rail, comprising subjecting a steel material having the chemical composition according to claim 2 to hot rolling where a finish temperature is 850° C. or higher and 950° C. or lower, then to cooling where a cooling start temperature is equal to or higher than a pearlite transformation start temperature, a cooling stop temperature is 350° C. or higher and 600° C. or lower, and a cooling rate is 2° C./s or higher and 10° C./s or lower; thereby producing the rail according to claim 2.

7. A method of manufacturing a rail, comprising subjecting a steel material having the chemical composition according to claim 3 to hot rolling where a finish temperature is 850° C. or higher and 950° C. or lower, then to cooling where a cooling start temperature is equal to or higher than a pearlite transformation start temperature, a cooling stop temperature is 350° C. or higher and 600° C. or lower, and a cooling rate is 2° C./s or higher and 10° C./s or lower; thereby producing the rail according to claim 3.

8. A method of manufacturing a rail, comprising subjecting a steel material having the chemical composition according to claim 4 to hot rolling where a finish temperature is 850° C. or higher and 950° C. or lower, then to cooling where a cooling start temperature is equal to or higher than a pearlite transformation start temperature, a cooling stop temperature is 350° C. or higher and 600° C. or lower, and a cooling rate is 2° C./s or higher and 10° C./s or lower; thereby producing the rail according to claim 4.

* * * * *